US011084157B2

(12) United States Patent
Yoshikane et al.

(10) Patent No.: US 11,084,157 B2
(45) Date of Patent: Aug. 10, 2021

(54) WORK TOOL

(71) Applicant: MAKITA CORPORATION, Anjo (JP)

(72) Inventors: Kiyonobu Yoshikane, Anjo (JP); Yoshitaka Machida, Anjo (JP); Taro Hisano, Anjo (JP); Hirokatsu Yamamoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 224 days.

(21) Appl. No.: 16/298,409

(22) Filed: Mar. 11, 2019

(65) Prior Publication Data

US 2019/0291255 A1 Sep. 26, 2019

(30) Foreign Application Priority Data

Mar. 21, 2018 (JP) ..... JP2018-053670

(51) Int. Cl.
*B25D 17/24* (2006.01)
*B25D 16/00* (2006.01)

(52) U.S. Cl.
CPC ..... *B25D 17/24* (2013.01); *B25D 16/006* (2013.01); *B25D 2216/0084* (2013.01); *B25D 2217/0092* (2013.01); *B25D 2250/005* (2013.01); *B25D 2250/201* (2013.01); *B25D 2250/221* (2013.01)

(58) Field of Classification Search
CPC ..... B25D 17/24; B25D 16/006; B25D 2216/0084; B25D 2217/0092; B25D 2250/005; B25D 2250/201; B25D 2250/221
USPC ..... 173/162.2, 105
See application file for complete search history.

(56) References Cited

U.S. PATENT DOCUMENTS 7,527,107 B2 * 5/2009 Berger ..... B25D 17/043 173/162.2

FOREIGN PATENT DOCUMENTS

JP 2016-022567 A 2/2016

OTHER PUBLICATIONS

Oct. 22, 2019 Search Report issued in European Patent Application No. 19162563.1.

* cited by examiner

*Primary Examiner* — Michelle Lopez
(74) *Attorney, Agent, or Firm* — Oliff PLC

(57) ABSTRACT

A work tool includes a motor, a driving mechanism, a housing, a handle, a detecting mechanism and an elastic support part. The detecting mechanism is configured to detect information corresponding to an operating state of the work tool. The elastic support part supports the detecting mechanism so as to be movable relative to the housing in at least two of a front-rear direction, an up-down direction and a left-right direction. The elastic support part includes at least one elastic member disposed between the detecting mechanism and the housing. The elastic support part has respectively different spring constants in the at least two directions.

19 Claims, 5 Drawing Sheets

WORK TOOL

CROSS-REFERENCE TO RELATED APPLICATION

The present application claims priority to Japanese patent application No. 2018-53670 filed on Mar. 21, 2018, the contents of which are fully incorporated herein by reference.

TECHNICAL FIELD

The present invention relates to a work tool which is configured to perform an operation on a workpiece by driving a tool accessory.

BACKGROUND ART

A work tool is known which performs an operation on a workpiece by linearly driving a tool accessory along a specified drive axis. Generally, in such a work tool, various precision instruments for controlling operation of the work tool are mounted. For example, a controller for controlling a motor is mounted in a work tool disclosed in Japanese Unexamined Patent Application Publication No. 2016-22567. The controller has a case having a pair of parallel side surfaces and is housed in a body housing.

SUMMARY

In the above-described work tool, elastic elements are disposed between right and left inner surfaces of a body housing and the side surfaces of the case in order to prevent wear of the case and suppress rattling of the controller. In the work tool in which relatively large vibration is caused when the tool accessory is driven, however, a precision instrument mounted therein is desired to be more appropriately protected from vibration.

Accordingly, it is an object of the present disclosure to provide a technique that may help rationally protect a precision instrument mounted in a work tool from vibration.

According to one aspect of the present disclosure, a work tool is provided which is configured to perform an operation on a workpiece by driving a tool accessory. The work tool includes a motor, a driving mechanism, a housing, a handle, a detecting mechanism and an elastic support part.

The driving mechanism is configured to perform at least a hammering operation by power of the motor. The hammering operation refers to an operation in which a tool accessory is linearly driven along a drive axis. The drive axis extends in a front-rear direction of the work tool. The housing houses at least the motor and the driving mechanism. The handle is connected to the housing and includes a grip part. The grip part crosses the drive axis and extends in an up-down direction orthogonal to the front-rear direction. The detecting mechanism is configured to detect information corresponding to an operating state of the work tool. The elastic support part supports the detecting mechanism so as to be movable relative to the housing in at least two of specified three directions. The specified three directions are the front-rear direction, the up-down direction and a left-right direction, which is orthogonal to the front-rear direction and the up-down direction. The elastic support part includes at least one elastic member disposed between the detecting mechanism and the housing. Further, the elastic support part has respectively different spring constants in the at least two directions.

The "operating state of the work tool" in the present aspect may include, for example, a moving state (typically, vibration in a specified direction and rotation around the drive axis) of the housing, a driving state of the motor and a driving state of the driving mechanism. Further, the "information corresponding to the operating state of the work tool" may refer, for example, to a physical quantity corresponding to (indicative of) the operating state of the work tool.

The manner in which the "elastic support part supports the detecting mechanism so as to be movable relative to the housing in at least two of specified three directions" may typically include the following examples. As one example, one elastic member may be disposed between the detecting mechanism and the housing in two or three directions and (elastically) supports the detecting mechanism so as to be movable relative to the housing in all of the two or three directions. As another example, one or more elastic members may be disposed between the detecting mechanism and the housing in each of the two or three directions and (elastically) support the detecting mechanism so as to be movable relative to the housing in the direction.

Further, the manner in which the "elastic support part has respectively different spring constants in the at least two directions" may typically include the following examples. As one example, one elastic member may have respectively different spring constants in the two or three directions. As another example, elastic members having different spring constants may be disposed respectively in the two or three directions.

Vibration is caused in the housing which houses the driving mechanism during the operation of the work tool. The detecting mechanism which is configured to detect the information corresponding to the operating state of the work tool is an example of a precision instrument, Therefore, it is preferable that the detecting mechanism is disposed such that transmission of vibration to the detecting mechanism is suppressed as much as possible in order to reduce the possibility of malfunction. According to the present aspect, the detecting mechanism is elastically supported relative to the housing in at least two of the front-rear, up-down and left-right directions by the elastic support part including at least one elastic member, so that the detecting mechanism can be protected from the vibration. Further, the elastic support part has respectively different spring constants in the at least two directions. In other words, the elastic support part is configured to suppress vibration transmission in the at least two directions to respectively different degrees. Therefore, according to the present aspect, the detecting mechanism can be elastically supported such that vibration transmission is suppressed in the at least two directions to respectively appropriate degrees, according to the information corresponding to the detected operating state of the work tool.

In one aspect of the present disclosure, the two directions may be the front-rear direction and the left-right direction.

In one aspect of the present disclosure, the work tool may further include a controller which is configured to control operation of the work tool based on the information detected by the detecting mechanism. The driving mechanism may be further configured to perform a rotating operation of rotationally driving the tool accessory around the drive axis by power of the motor. The detecting mechanism may be configured to detect information corresponding to vibration of the housing in the front-rear direction and information corresponding to rotation of the housing around the drive axis, as the information corresponding to the operating state of the work tool. The controller may be configured to control rotation speed of the motor according to the vibration during the hammering operation. Further, the controller may be configured to stop the rotating operation in a case where excessive rotation around the drive axis occurs during the rotating operation. The elastic support part may be configured such that a first spring constant in the front-rear direction is larger than a second spring constant in the left-right direction.

In one aspect of the present disclosure, the elastic support part may support the detecting mechanism so as to be movable in all of the three directions relative to the housing.

Further, in one aspect of the present disclosure, the elastic support part may support the detecting mechanism so as to be movable in all of the three directions relative to the housing. In addition, the elastic support part may have a third spring constant in the up-down direction which is smaller than the first spring constant in the front-rear direction and larger than the second spring constant in the left-right direction. In other words, the elastic support part may have a property that the degrees of flexibility (ease of deformation) in the left-right direction, the up-down direction and the front-rear direction under the same load is larger in this order.

In one aspect of the present disclosure, the at least one elastic member may elude an annular first elastic member. The first elastic member may be mounted onto an outer periphery of the detecting mechanism and support the detecting mechanism so as to be movable in the front-rear direction relative to the housing.

In one aspect of the present disclosure, the at least one elastic member may include at least one second elastic member. The at least one second elastic member may each have a first surface in contact with the detecting mechanism and a second surface in contact with the housing. Further, the first surface and the second surface may be in parallel to each other, and opposed in a specified one of the three directions. Furthermore, a center of gravity of the first surface and a center of gravity of the second surface may be located on an imaginary straight line extending in the specified one direction. Further, in the present aspect, the at least one second elastic member may include two second elastic members disposed on left and right sides of the detecting mechanism on the straight line extending in the left-right direction. Each of the two second elastic members may have a uniform cross-section along the straight line.

In one aspect of the present disclosure, the at least one elastic member may further include a third elastic member which is disposed in contact with the first elastic member in the up-down direction. The first and third elastic members may support the detecting mechanism so as to be movable in the up-down direction relative to the housing.

In one aspect of the present disclosure, the motor may be disposed below the drive axis such that a rotation axis of a motor shaft extends in a direction crossing the drive axis. Further, the detecting mechanism may be housed in a region of the housing below the motor.

DETAILED DESCRIPTION OF THE EMBODIMENTS

An embodiment of the present disclosure is now described with reference to the drawings. In the following embodiment, a hammer drill 1 is described as an example of a work tool which is configured to perform a specified operation by driving a tool accessory 91. The hammer drill 1 is configured to perform an operation hereinafter referred to as a hammering operation) of linearly driving the tool accessory 91 coupled to a tool holder 39 along a specified drive axis A1, and an operation (hereinafter referred to as a drilling operation) of rotationally driving the tool accessory 91 around the drive axis A1.

Figure 1:
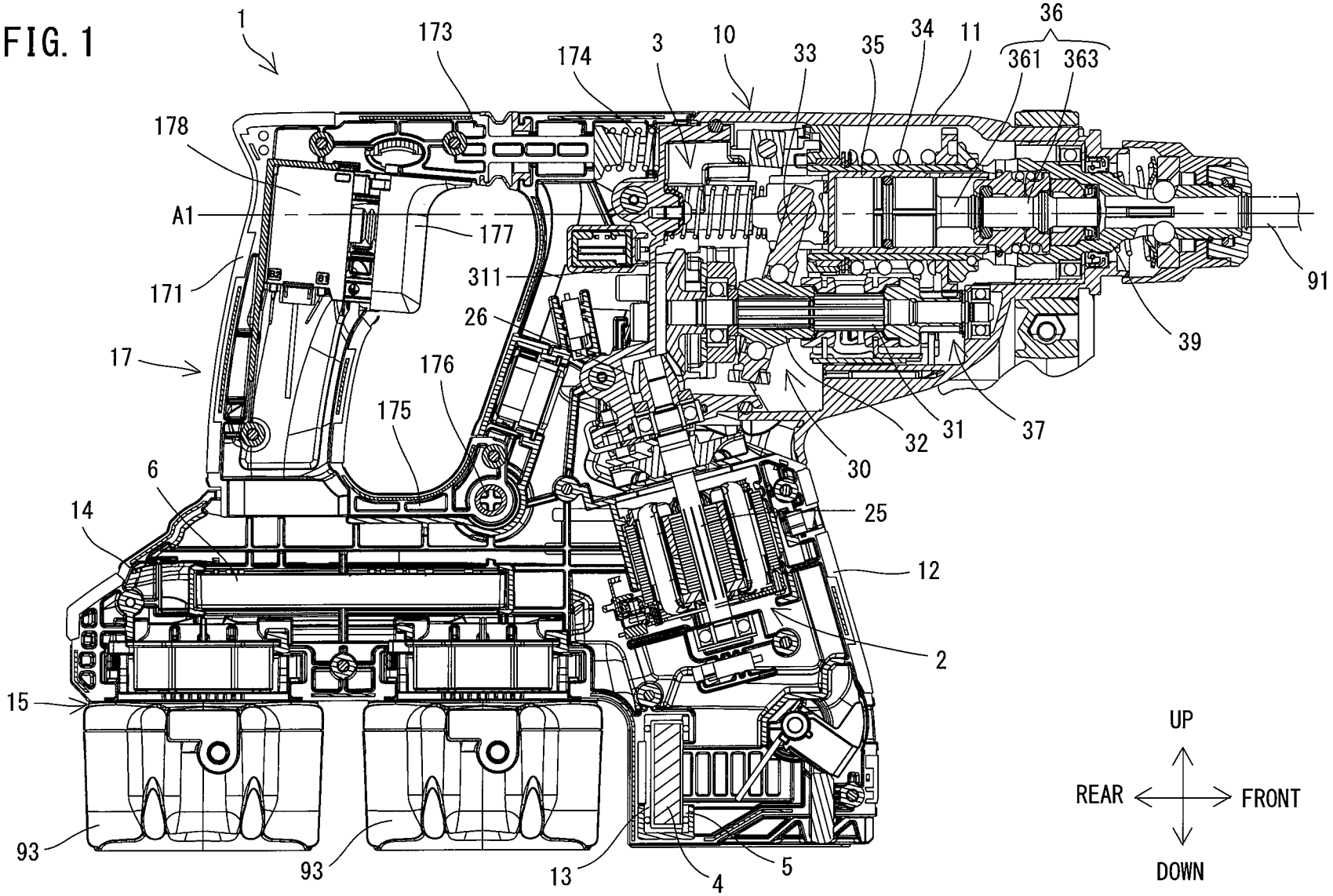
FIG. 1 is a sectional view of a hammer drill.
Figure 2:
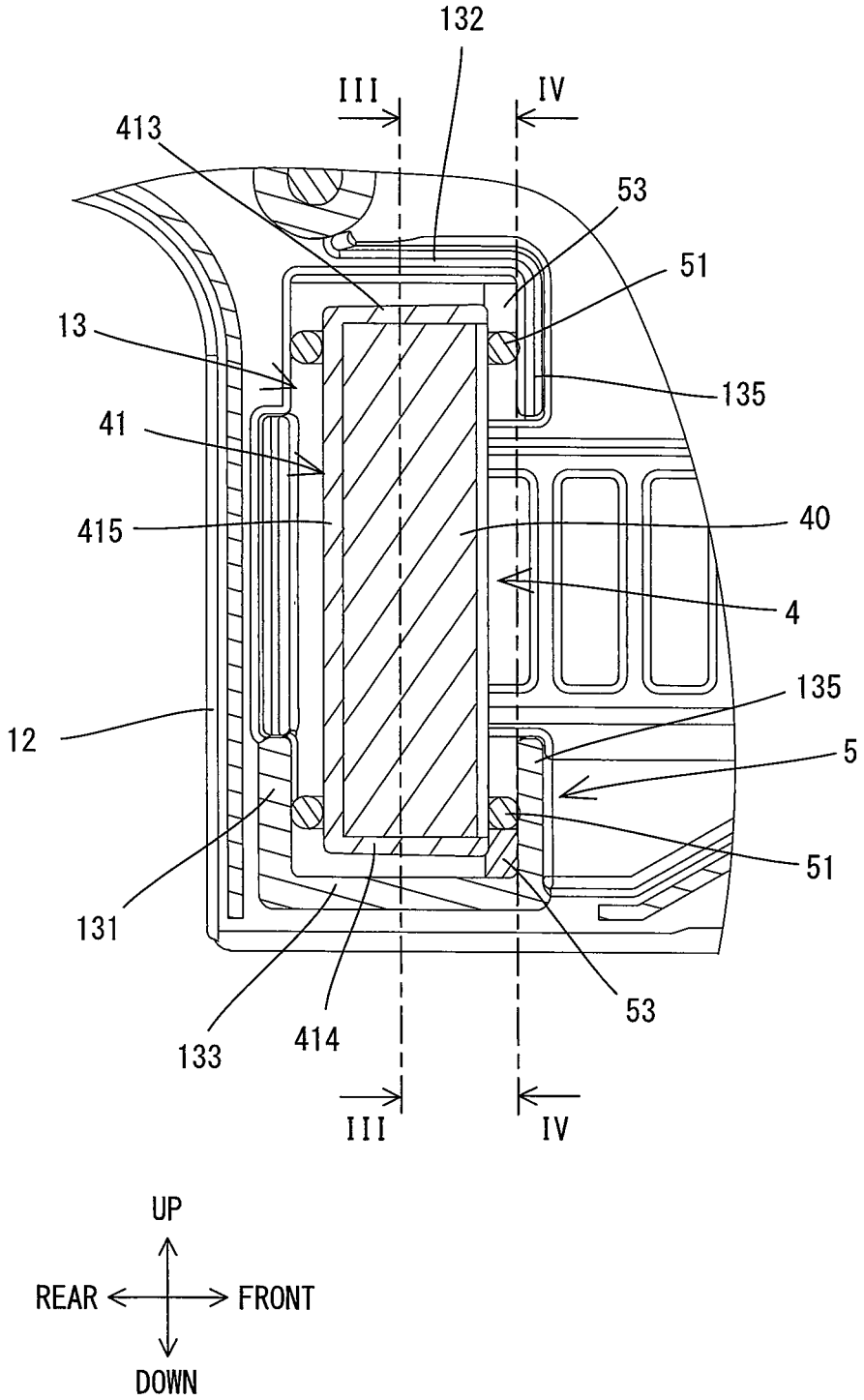
FIG. 2 is a partial, enlarged view of FIG. 1, showing a sensor housing space and its surrounding region.
Figure 3:
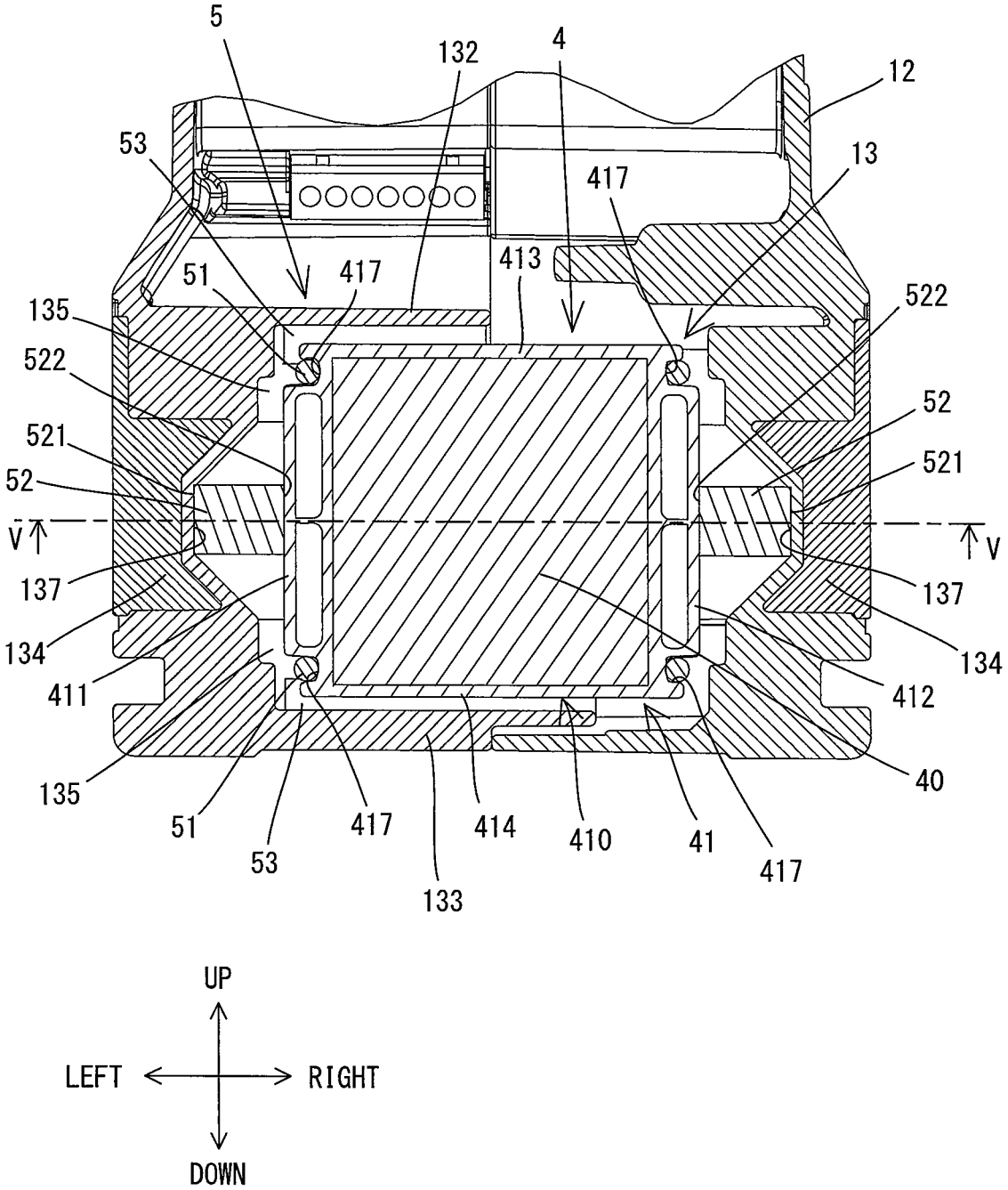
FIG. 3 is a sectional view taken along line in FIG. 2.
Figure 4:
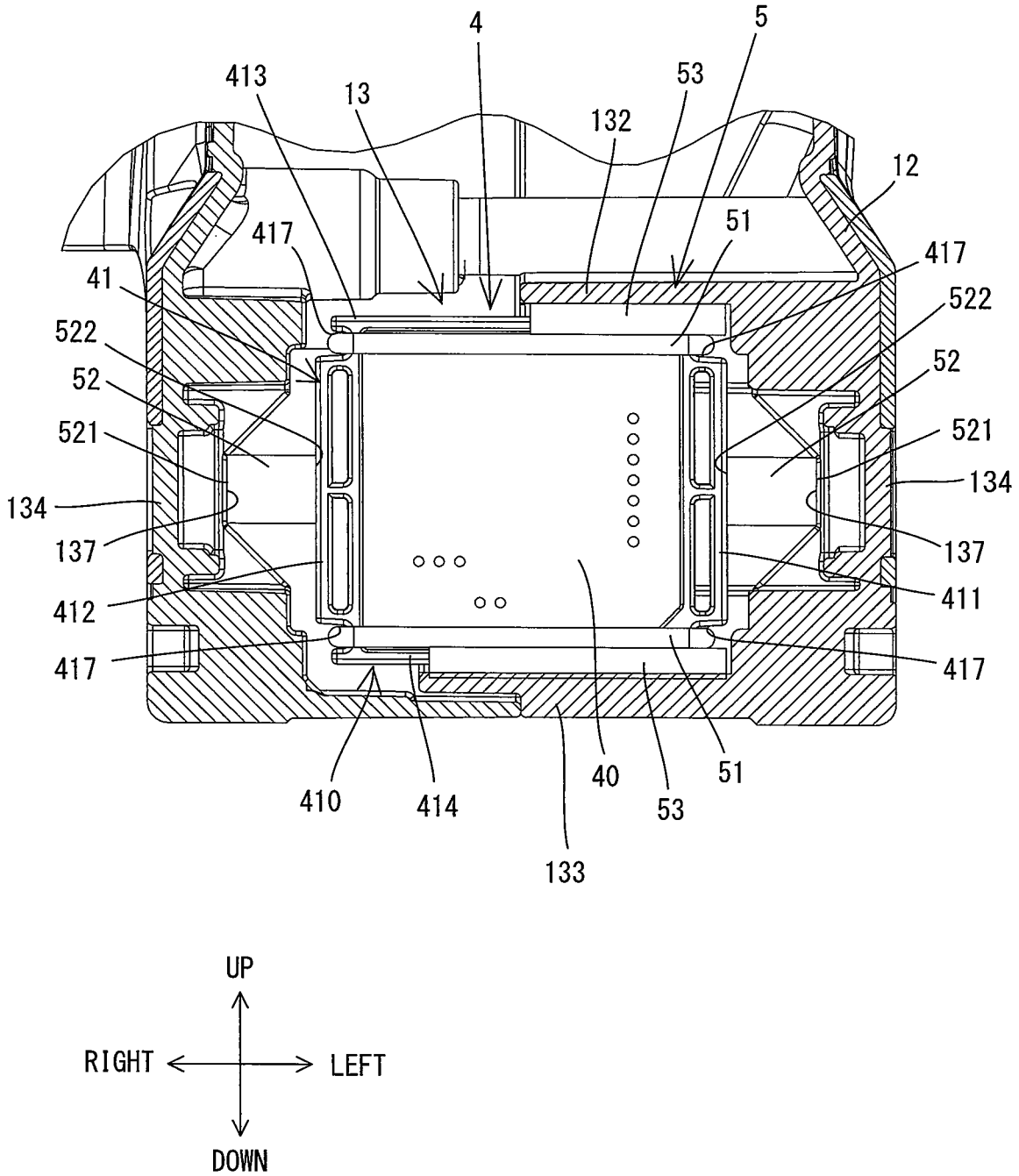
FIG. 4 is a sectional view taken along line IV-IV in FIG. 2.
Figure 5:
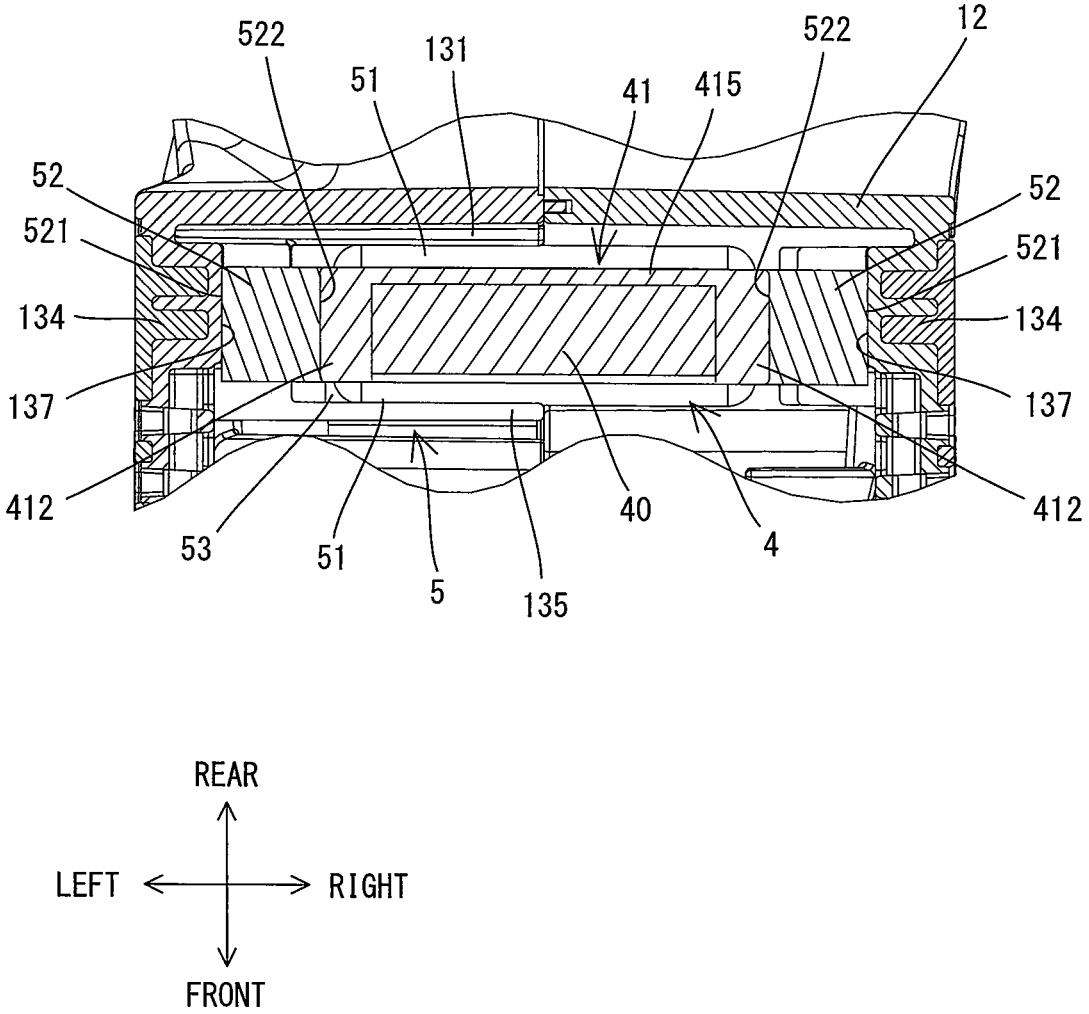
FIG. 5 is a sectional view taken along line V-V in FIG. 3.

First, the general structure of the hammer drill 1 is described with reference to FIG. 1. As shown in FIG. 1, an outer shell of the hammer drill 1 is mainly formed by a body housing 10 and a handle 17.

The body housing 10 mainly includes three parts, that is, a driving-mechanism-housing part 11 which houses a driving mechanism 3, a motor-housing part 12 which houses a motor 2, and a controller-housing part 14 which houses a controller 6. The body housing 10 as a whole is generally Z-shaped in a side view.

The driving-mechanism-housing part 11 has an elongate shape extending in an axial direction of the drive axis A1 (a drive axis A1 direction). The tool holder 39 is provided in one end portion (an axial end portion) of the driving-mechanism-housing part 11 in the drive axis A1 direction and configured such that the tool accessory 91 can be removably coupled thereto. The tool holder 39 is supported by the driving-mechanism-housing part 11 so as to be rotatable around the drive axis A1. The tool holder 39 is configured to hold the tool accessory 91 so as to be non-rotatable and to be linearly movable in the drive axis A1 direction.

The motor-housing part 12 is connected fixedly and immovably relative to the driving-mechanism-housing part 11 at the other axial end portion of the driving-mechanism-housing part 11 in the drive axis A1 direction. The motor-housing part 12 protrudes in a direction crossing the drive axis A1 and away from the drive axis A1. The motor 2 is disposed within the motor-housing part 12 such that a rotation axis of a motor shaft 25 extends in a direction crossing the drive axis A1 (specifically, a direction oblique to the drive axis A1).

In the following description, for convenience sake, the extending direction of the drive axis A1 is defined as a front-rear direction of the hammer drill 1. In the front-rear direction, the side of one end portion of the hammer drill 1 in which the tool holder 39 is disposed is defined as a front side (also referred to as a front end region side) of the hammer drill 1 and the opposite side is defined as a rear side. Further, a direction Which is orthogonal to the drive axis A1 and which corresponds to the extending direction of the rotation axis of the motor shaft 25 is defined as an up-down direction of the hammer drill 1. In the up-down direction, a direction toward which the motor-housing part 12 protrudes from the driving-mechanism-housing part 11 is defined as a downward direction and the opposite direction is defined as an upward direction. A direction orthogonal to the front-rear direction and the up-down direction is defined as a left-right direction.

The controller-housing part 14 is a portion of the body housing 10 which extends rearward from a generally central portion (where the motor 2 is housed) of the motor-housing part 12 in the up-down direction. Further, a battery-mounting part 15 is provided on a lower end of the controller-housing part 14. The hammer drill 1 may be operated by power supplied from a battery 93 mounted to the battery-mounting part 15.

The handle 17 includes a grip part 171, an upper connection part 173 and a lower connection part 175, and is generally C-shaped as a whole. The grip part 171 is a cylindrical part which generally extends in the up-down direction, spaced rearward from the body housing 10. The grip part 171 is configured to be held by a user. A trigger 177, which can be depressed (pulled) by a user, is provided on an upper end portion of the grip part 171. A switch 178, which may be turned on and off in response to a depressing operation of the trigger 177, is housed within the grip part 171. The upper connection part 173 extends forward from the upper end portion of the grip part 171 and is connected to an upper rear end portion of the body housing 10. The lower connection part 175 extends forward from a lower end portion of the grip part 171 and is connected to a central rear end portion of the body housing 10. The lower connection part 175 is disposed on an upper side of the controller-housing part 14.

The detailed structure of the hammer drill 1 is now described.

First, the internal structure of the driving-mechanism-housing part 11 is described. As shown in FIG. 1, the driving-mechanism-housing part 11 is a portion of the body housing 10 which extends along the drive axis A1 in the front-rear direction. The driving-mechanism-housing part 11 houses the driving mechanism 3 which is configured to drive the tool accessory 91 by power of the motor 2. In the present embodiment, the driving mechanism 3 includes a motion-converting mechanism 30, a striking mechanism 36 and a rotation-transmitting mechanism 37, The motion-converting mechanism 30 and the striking mechanism 36 are configured to perform the hammering operation of linearly driving the tool accessory 91 along the drive axis A1 The rotation-transmitting mechanism 37 is configured to perform the drilling operation of rotationally driving the tool accessory 91 around the drive axis A1. The structures of the motion-converting mechanism 30, the striking mechanism 36 and the rotation-transmitting mechanism 37 are well known and therefore only briefly described below.

The motion-converting mechanism 30 is configured to convert rotation of the motor shaft 25 into linear motion and transmit it to the striking mechanism 36. In the present embodiment, a swinging member 33 is used in the motion-converting mechanism 30. The motion-converting mechanism 30 includes an intermediate shaft 31, a rotary body 32, the swinging member 33 and a piston cylinder 35. The intermediate shaft 31 extends in the front-rear direction in parallel to the drive axis A1. The rotary body 32 is mounted on the intermediate shaft 31, The swinging member 33 is mounted on the rotary body 32 and caused to swing in the front-rear direction along with rotation of the rotary body 32. The piston cylinder 35 has a bottomed circular cylindrical shape and is supported within a circular cylindrical sleeve 34 so as to be movable in the front-rear direction. The piston cylinder 35 is caused to reciprocate in the front-rear direction along with a swinging movement of the swinging member 33. Further, the sleeve 34 is coaxially connected to a rear end of the tool holder 39 and integrated with the tool holder 39. The tool holder 39 and the sleeve 34, which are integrated together, are supported rotatable around the drive axis A1.

The striking mechanism 36 is configured to linearly move and strike the tool accessory 91 so as to linearly drive the tool accessory 91 along the drive axis A1 In the present embodiment, the striking mechanism 36 includes a striking element in the form of a striker 361 and an intermediate element in the form of an impact bolt 363. The striker 361 is disposed within the piston cylinder 35 so as to be slidable in the drive axis A1 direction, A space behind the striker 361 within the piston cylinder 35 is defined as an air chamber which functions as an air spring.

When the motor 2 is driven and the piston cylinder 35 is moved forward, air within the air chamber is compressed so that the internal pressure increases. Therefore, the striker 361 is pushed forward at high speed and collides with the impact bolt 363, thereby transmitting its kinetic energy to the tool accessory 91. As a result, the tool accessory 91 is linearly driven along the drive axis A1 and strikes a workpiece. On the other hand, when the piston cylinder 35 is moved rearward, the air within the air chamber expands so that the internal pressure decreases and the striker 361 is retracted rearward. By repeating such operations, the motion-converting mechanism 30 and the striking mechanism 36 perform the hammering operation.

The rotation-transmitting mechanism 37 is configured to transmit rotating power of the motor shaft 25 to the tool holder 39. In the present embodiment, the rotation-transmitting mechanism 37 is configured as a gear speed reducing mechanism including a plurality of gears to appropriately reduce the speed of rotation of the motor 2 and transmit the rotation to the tool holder 39.

The hammer drill 1 of the present embodiment is configured such that one of three operation modes, that is, a hammer drill mode, a hammer mode and a drill mode, can be selected by operating a mode switching dial (not shown) which is rotatably disposed on a side of the driving-mechanism-housing part 11. In the hammer drill mode, the hammering operation and the drilling operation are performed by driving the motion-converting mechanism 30 and the rotation-transmitting mechanism 37. In the hammer node, only the hammering operation is performed by interrupting power transmission in the rotation-transmitting mechanism 37 and driving only the motion-converting mechanism 30. In the drilling mode, only the drilling operation is performed by interrupting power transmission in the motion-converting mechanism 30 and driving only the rotation-transmitting mechanism 37. A mode switching mechanism is provided within the body housing 10 (specifically, within the driving-mechanism-housing part 11) and connected to the mode switching dial to switch the motion-converting mechanism 30 and the rotation-transmitting mechanism 37 between a transmission state and a transmission-interrupted state according to an operation mode selected with the mode switching dial. The structure of such a mode switching mechanism is well known and therefore it is not described in further detail here and not shown in the drawings.

Next, the internal structure of the motor-housing part 12 is described. As shown in FIG. 1, the motor-housing part 12 is a portion of the body housing 10 which is connected to the rear end portion of the driving-mechanism-housing part 11 and generally extends in the up-down direction. The motor 2 is housed in the central portion of the motor-housing part 12 in the up-down direction. In the present embodiment, a direct current (DC) brushless motor is employed as the motor 2 since it is compact and has high-output. The rotation axis of the motor shaft 25 extends obliquely downward and forward relative to the drive axis A1. An upper end portion of the motor shaft 25 protrudes into the driving-mechanism-housing part 11, and has a small bevel gear 26 formed thereon. The small bevel gear 26 is engaged with a large bevel gear 311 fixed to a rear end portion of the intermediate shaft 31.

The controller-housing part 14 is a portion of the body housing 10 which extends rearward from the central portion of the motor-housing part 12. The controller-housing part 14 houses the controller 6 which is configured to control operation of the hammer drill 1 (such as driving of the motor 2), In the present embodiment, a control circuit formed by a microcomputer, including a CPU, a ROM and a RAM etc., is employed as the controller 6. The controller 6 is electrically connected to the motor 2, the switch 178, the battery-mounting part 15 and a sensor unit 4, which will be described later, via wiring (not shown).

Two battery-mounting parts 15 are provided on a lower end of the controller-housing part 14. The battery-mounting parts 15 are each configured such that a rechargeable battery 93 can be removably mounted thereto. In the present embodiment, the battery-mounting parts 15 are arranged side by side in the front-rear direction. The battery 93 can be electrically connected to the battery-mounting part 15 when slid from the left and engaged with the battery-mounting part 15. When the two batteries 93 are mounted to the battery-mounting parts 15, lower surfaces of the batteries 93 are flush with each other. The structures of the battery 93 and the battery-mounting part 15 are well known and therefore they are not described in further detail here.

As shown in FIG. 1, a lower end portion of the motor-housing part 12 is located in front of the batteries 93 mounted to the battery-mounting parts 15 and configured such that a lower surface of the lower end portion is generally flush with the lower surfaces of the batteries 93. The lower end portion also serves as a battery-protection part for protecting the batteries 93 from an external force. Specifically, the lower end portion of the motor-housing part 12 is provided to extend below the motor 2 in order to secure the stability of the hammer drill 1 when the hammer drill 100 is placed on a flat surface and also to protect the batteries 93 from the external force. An internal space of the lower end portion having such a structure tends to become a dead space. Therefore, in the present embodiment, this space is effectively utilized to house the sensor unit 4. The structure of the sensor unit 4 and a structure for supporting the sensor unit 4 will be described in detail later.

The structure of connecting the handle 17 to the body housing 10 is now described. As described above, the handle 17 includes the grip part 171 extending in the up-down direction and the upper and lower connection parts 173, 175 which connect the grip part 171 and the body housing 10, in the present embodiment, the handle 17 is elastically connected to the body housing 10 so as to be movable in at least the front-rear direction relative to the body housing 10. More specifically, a front end portion of the upper connection part 173 protrudes into a rear end portion of the driving-mechanism-housing part 11. A biasing spring 174 is disposed between the front end portion of the upper connection part 173 and a support wall formed within the rear end portion of the driving-mechanism-housing part 11. The biasing spring 174 biases the handle 17 and the body housing 10 in a direction away from each other in the front-rear direction. The lower connection part 175 is rotatably supported relative to the motor-housing part 12, via a support shaft 176 extending in the left-right direction. Such a so-called vibration-proof handle structure can suppress transmission of vibration from the body housing 10 to the handle 17 (particularly, to the grip part 171).

The structure of the sensor unit 4 is now described. In the present embodiment, as shown in FIGS. 2 to 5, the sensor unit 4 includes a sensor body 40 and a case 41 which houses the sensor body 40.

Although not shown in detail, the sensor body 40 includes a sensor for detecting information corresponding to the operating state of the hammer drill 1, a microcomputer including a CPU, a ROM and a RAM, and a board on which the sensor and the microcomputer are mounted. In the present embodiment, the sensor is configured to detect information corresponding to a moving state of the body housing 10, Which is an example of the operating state of the hammer drill 1. The controller 6 is configured to control the operation of the hammer drill 1 (specifically, driving of the motor 2) based on the moving state of the body housing 10.

More specifically, the controller 6 is configured to control the rotation speed of the motor 2 based on vibration of the body housing 10 in the front-rear direction, in an operation mode involving the hammering operation. Further, the controller 6 is configured to stop driving of the motor 2 based on rotation of the body housing 10 around the drive axis A1, in an operation mode involving the drilling operation. The vibration of the body housing 10 in the front-rear direction and the rotation of the body housing 10 around the drive axis A1 are each an example of the moving state of the body housing 10. An example of information (physical quantity, indicator or parameter) corresponding to both of the vibration of the body housing 10 in the front-rear direction and the rotation of the body housing 10 around the drive axis A1 is acceleration. In the present embodiment, as the sensor, an acceleration sensor having a well-known structure is employed which is capable of detecting acceleration in the front-rear direction and the left-right direction.

The microcomputer of the sensor body 40 appropriately performs arithmetic processing based on the acceleration in the front-rear direction which is detected by the sensor, and determines whether or not the vibration of the body housing 10 in the front-rear direction exceeds a specified limit. In a case where the vibration of the body housing 10 in the front-rear direction exceeds the limit, the microcomputer outputs a specific signal (hereinafter referred to as a vibration signal) to the controller 6. It is noted that the state in which the vibration of the body, housing 10 in the front-rear direction exceeds the specified limit may correspond to a state in which the tool accessory 91 starts striking the workpiece and the motor 2 shifts from an unloaded state to a loaded state.

Similarly, the microcomputer of the sensor body 40 appropriately performs arithmetic processing based on the acceleration in the left-right direction which is detected by the sensor, and determines whether or not the rotation of the body housing 10 around the drive axis A1 exceeds a specified limit. In a case where the rotation of the body housing 10 around the drive axis A1 exceeds the limit, the microcomputer outputs a specific signal (hereinafter referred to as a rotation signal), which is different from the vibration signal, to the controller 6. It is noted that the state in which the rotation of the body housing 10 around the drive axis A1 exceeds the specified limit may correspond to a state in Which the body housing 10 excessively rotates around the drive axis A1. Such a state may typically occur, for example, when the tool accessory 91 is locked biting into a workpiece, so that the tool holder 39 falls into a non-rotatable state (also referred to as a locked state or blocked state) and excessive reaction torque acts on the body housing 10.

It is noted that the sensor body 40 may not need to have the microcomputer. In such a case, the sensor body 40 may directly output a signal indicating a detection result of the sensor to the controller 6 and the controller 6 may make the above-described determination. Control of operation of the hammer drill 1 based on signals outputted from the sensor body 40 will be described in detail later.

As shown in FIGS. 2 to 5, the case 41 has a rectangular box-like shape which is longer in the left-right direction and has an open front, as a whole. More specifically, the case 41 has a rear wall (bottom wall) 415 and a peripheral wall 410 which protrudes forward from an outer edge of the rear wall 415 and surrounds the outer edge. The peripheral wall 410 includes a left wall part 411, a right wall part 412, an upper wall part 413 and a lower wall part 414. The sensor body 40 is housed in a recess defined by the rear wall 415 and the peripheral wall 410. Further, a recess 417 is formed in each of four corners of the case 41. More specifically, two recesses 417 recessed rightward are respectively formed in upper and lower end portions of the left wall part 411, acid similarly, two recesses 417 recessed leftward are respectively formed in upper and lower end portions of the right wall part 412.

A structure of holding the sensor unit 4 is now described.

As shown in FIGS. 2 to 5, in the present embodiment, the sensor unit 4 is supported so as to be movable relative to the body housing 10 (i.e. elastically supported) by an elastic support part 5 which is disposed between the body housing 10 and the sensor unit 4. The elastic support part 5 includes a plurality of elastic members (more specifically, a first elastic member 51, a second elastic member 52 and a third elastic member 53). The first elastic member 51 is interposed between the sensor unit 4 and the body housing 10 in the front-rear direction. The second elastic member 52 is interposed between the sensor unit 4 and the body housing 10 in the left-right direction. The first elastic member 51 and the third elastic member 53 are interposed between the sensor unit 4 and the body housing 10 in the up-down direction. With such a structure, the sensor unit 4 is held within a sensor housing space 13 so as to be movable in the three directions of the front-rear, left-right and up-down directions relative to the body housing 10.

The sensor housing space 13 is now described. As shown in FIG. 1, the sensor housing space 13 is provided in a lower end portion of the motor-housing part 12. As shown in FIGS. 2 to 5, the sensor housing space 13 is surrounded by a rear wall 131, an upper wall 132, a lower wall 133 and right and left side walls 134 and is open to the front. Further, a pair of upper and lower ribs 135 are formed along a front end portion of the sensor housing space 13. The ribs 135 each extend in the left-right direction so as to face the rear wall 131. The upper and lower ribs 135 protrude downward from the upper wall 132 and upward from the lower wall 133, respectively. In the present embodiment, the body housing 10 is formed by connecting right and left halves and the ribs 135 are provided only on the left half of the body housing 10. The sensor housing space 13 is slightly larger than the sensor unit 4 (the case 41) in the front-rear, left-right and up-down directions.

As shown in FIGS. 2 to 5, the first elastic member 51 is an annular elastic member (a so-called O-ring). In the present embodiment, two such first elastic members 51 having the same structure are mounted onto an outer periphery of the case 41. More specifically, one of the first elastic members 51 is engaged with the two recesses 417 respectively formed in right and left upper end portions of the ease 41 and mounted to surround an outer periphery of an upper end portion of the case 41, The other first elastic member 51 is engaged with the two recesses 417 respectively formed in right acid left lower end portions of the case 41 and mounted to surround an outer periphery of a lower end portion of the case 41. Thus, a movement of the first elastic members 51 relative to the case 41 is restricted in the up-down direction, Each of the first elastic members 51 mounted on the case 41 is partially disposed on the front and rear sides of the case 41.

The second elastic member 52 is an elastic member having a rectangular column shape, More specifically, the second elastic member 52 has a rectangular parallelepiped shape, Specifically, the second elastic member 52 has a pair of opposed end surfaces parallel to each other, and has a uniform cross-section along an axis passing through the centers of gravity of the end surfaces of the second elastic member 52. In the present embodiment, two such second elastic members 52 having the same structure are fixed within the lower end portion of the motor-housing part 12. More specifically, inner surfaces of the right and left side walls 134 respectively include flat-surface parts 137 which are parallel to each other and face each other in the left-right direction. One end surface (hereinafter referred to as a first surface 521) of each of the second elastic members 52 in the axial direction is affixed to the corresponding flat-surface part 137 such that the axes and the centers of gravity of the second elastic members 52 are on a straight line extending in the left-right direction.

The third elastic member 53 is a sheet-like elastic member. In the present embodiment, two such third elastic members 53 are fixed within the lower end portion of the motor-housing part 12. More specifically, the third elastic members 53 are respectively affixed to rear surfaces of the upper and lower ribs 135. An upper end of the upper third elastic member 53 is held in contact with a lower surface of the upper wall 132. A lower end of the lower third elastic member 53 is held in contact with an upper surface of the lower wall 133.

In the present embodiment, the first elastic members 51 and the third elastic members 53 are formed of rubber, Rubber used for the first elastic member 51 has a hardness of approximately 50 degrees and a relatively high elastic coefficient, while rubber used for the third elastic member 53 has a hardness of approximately 65 degrees and a higher elastic coefficient than that of the rubber used for the first elastic member 51, The second elastic member 52 is formed of polymeric foam (more specifically, urethane sponge) having an elastic coefficient which is lower than that of the rubber used for the first elastic member 51.

When the sensor unit 4 having the first elastic members 51 mounted thereon is disposed in the sensor housing space 13, portions of the first elastic members 51 which are disposed on the front and rear sides of the case 41 are respectively held in contact with the ribs 135 and the rear wall 131 while being slightly compressed in the front-rear direction. In this state, the first elastic members 51 hold the sensor unit 4 apart from the ribs 135 and the rear wall 131. Further, second surfaces 522 which are opposed to the first surfaces 521 of the second elastic members 52 fixed on the inner surfaces of the right and left side walls 134 are respectively held in contact with the right and left side walls 411, 412 of the case 41, while the second elastic members 52 are slightly compressed in the left-right direction. In this state, the second elastic members 52 hold the sensor unit 4 apart from the right and left side walls 134. Furthermore, the third elastic members 53 fixed to the rear surfaces of the upper and lower ribs 135 are respectively held in contact with upper and lower ends of the first elastic members 51 mounted onto the upper and lower end portions of the case 41, while being slightly compressed in the up-down direction. In this state, the third elastic members 53 hold the sensor unit 4 apart from the upper and lower walls 132, 133.

In the above-described manner, the sensor unit 4 is supported by the elastic support part the first elastic members 51, the second elastic members 52 and the third elastic members 53) so as to be movable in the three directions of the font-rear, left-right and up-down directions relative to the body housing 10. The elastic support part 5 as a whole has a spring constant K1 in the front-rear direction, a spring constant K2 in the left-right direction and a spring constant K3 in the up-down direction Which are set to have the following relationship. The spring constant K1 is larger than the spring constant K3 and the spring constant K3 is larger than the spring constant K2. In other words, the spring constant K1 in the front-rear direction, the spring constant K2 in the left-right direction and the spring constant K3 in the up-down direction satisfy the relationship of K1>K3 K2. In other words, the elastic support part 5 has a property that the degrees of flexibility (ease of deformation) in the left-right direction, the up-down direction and the front-rear direction under the same load are larger in this order. It is noted that the spring constant K1 in the front-rear direction corresponds to the spring constant of the portions of the first elastic members 51 which are disposed on the front and rear sides of the sensor unit 4. The spring constant K2 in the left-right direction corresponds to the spring constant of the second elastic members 52 which are disposed on the right and left sides of the sensor unit 4. The spring constant K3 in the up-down direction corresponds to the spring constant of portions of the first and third elastic members 51 and 53 which are disposed on the upper and lower sides of the sensor unit 4. As described above, the third elastic member 53 has a higher hardness (larger elastic coefficient) than the first elastic member 51, but the spring constant K3 in the up-down direction is rendered smaller than the spring constant K1 in the front-rear direction by combination of the first elastic member 51 and the third elastic member 53.

Operation of the hammer drill 1 are now described.

First, operation of the hammer drill 1 when the hammer drill mode is selected as the operation mode is described. When a user depresses the trigger 177, the controller 6 starts driving the motor 2. Then, the driving mechanism 3 starts the hammering operation and the drilling operation. The controller 6 drives the motor 2 at a first rotation speed when a vibration signal is not outputted from the sensor body 40 and the motor 2 is in the unloaded state (in other words, when the tool accessory 91 does not strike the workpiece), When the motor 2 enters the loaded state (on other words, when the tool accessory 91 starts striking the workpiece) and a vibration signal is outputted from the sensor body 40, the controller 6 drives the motor 2 at a second rotation speed, which is higher than the first rotation speed. It is noted that the controller 6 may determine whether or not the motor 2 enters the loaded state, based on other information (for example, driving current of the motor 2) in addition to the vibration signal. When the trigger 177 is released and the switch 178 is turned off, the controller 6 stops energization to the motor 2 to stop driving the motor 2.

Further, when a rotation signal is outputted from the sensor body 40 while the switch 178 in on, the controller 6 determines that the body housing 10 has excessively rotated around the drive axis A1 and then stops driving the motor 2 to stop the drilling operation of the driving mechanism 3. Accordingly, further rotation can be prevented when such excessive rotation is caused by a locked state of the tool holder 39. It is noted that the controller 6 may determine the occurrence of such excessive rotation based on other information (for example, torque acting on the tool accessory 91) in addition to the rotation signal. When stopping the drilling operation, it may be preferable that the controller 6 not only stops energization to the motor 2, but also electrically brakes the motor 2 in order to prevent the motor shaft 25 from continuing rotating by inertia of the rotor.

Next, operation of the hammer drill 1 when the hammer mode is selected as the operation mode is described. When a user depresses the trigger 177, the controller 6 starts driving the motor 2. Then, the driving mechanism 3 starts the hammering operation. Like in the hammer drill mode, the controller 6 increases the rotation speed of the motor 2 from the first rotation speed to the second rotation speed when a vibration signal is outputted from the sensor body 40. The controller 6 stops driving the motor 2 when the trigger 177 is released and the switch 178 is turned off. In the hammer mode in which the drilling operation is not performed, the controller 6 need not perform control based on a rotation signal.

Further, operation of the hammer drill 1 when the drill mode is selected as the operation mode is described. When a user depresses the trigger 177, the controller 6 starts driving the motor 2. Then, the driving mechanism 3 starts the drilling operation. Like in the hammer drill mode, the controller 6 stops driving the motor 2 when the switch 178 is turned off or when a rotation signal is outputted from the sensor body 40 while the switch 178 is on. In the drill mode in which the hammering operation is not performed, the controller 6 need not perform control based on a vibration signal.

As described above, in the present embodiment, the sensor unit 4, which is a precision instrument, is supported by the elastic support part 5 including the first elastic members 51, the second elastic members 52 and the third elastic members 53 so as to be movable in the front-rear, left-right and up-down directions relative to the body housing 10, so that the sensor unit 4 can be protected from vibration. Further, the elastic support part 5 has respectively different spring constants K1, K2, K3 in the front-rear, left-right and up-down directions. The elastic support part 5 is thus configured to suppress vibration transmission in the three directions to respectively different degrees. Therefore, the sensor unit 4 can be elastically supported such that vibration transmission is suppressed in the three directions to respectively appropriate degrees, according to information corresponding to the operating state of the hammer drill 1 to be detected by the sensor unit 4.

More specifically, in the present embodiment, the sensor unit 4 detects, as the information corresponding to vibration of the body housing 10 in the front-rear direction and rotation of the body housing 10 around the drive axis A1 (both of which are the operating state of the hammer drill 1), acceleration in the front-rear direction and acceleration in the left-right direction, respectively. Further, the controller 6 controls operation of the hammer drill 1 based on detected acceleration. In order to accurately detect the vibration in the front-rear direction, it is preferred that the vibration in the front-rear direction is transmitted to the sensor unit 4 to some extent. However, when determining whether or not the body housing 10 has excessively rotated around the drive axis A1, it is preferred that a relatively small movement of the body housing 10 around the drive axis A1 is not transmitted to the sensor unit 4 in order to prevent erroneous detection. In the present embodiment, the elastic support part 5 has the spring constant K1 in the front-rear direction which is larger than the spring constant K2 in the left-right direction, so that the vibration in the front-rear direction can be transmitted to the sensor unit 4 to some extent, while the transmission of relatively small vibration in the left-right direction can be suppressed. Therefore, the sensor unit 4 is capable of appropriately detecting the information corresponding to the vibration in the front-rear direction and the rotation around the drive axis A1. Based on the information detected by the sensor unit 4, the controller 6 is capable of controlling the rotation speed of the motor 2 according to the vibration in the front-rear direction during the hammering operation, and stopping the drilling operation of the driving mechanism 3 when excessive rotation is caused during the drilling operation.

Further, the elastic support part 5 has the spring constant K3 in the up-down direction which is smaller than the spring constant K1 in the front-rear direction and larger than the spring constant K2 in the left-right direction. In other words, the spring constants K1, K2, K3 satisfy the relationship of K1>K3>K2. In other words, the degrees to which the elastic support part 5 suppresses vibration transmission in the left-right direction, the up-down direction and the front-rear direction are larger in this order. In the present embodiment, the information used by the controller 6 for operation control is the vibration of the body housing 10 in the front-rear direction and the rotation of the body housing 10 around the drive axis A1 Therefore, the spring constants K1, K2, K3 are set such that vibration is not transmitted so much in the up-down direction as in the front-rear direction and vibration transmission is not suppressed so much in the up-down direction as in the left-right direction.

Furthermore, in the present embodiment, a structure for elastically supporting the sensor unit 4 in the front-rear direction reealized in a simple manner by mounting the first elastic members 51 in the form of O-rings onto the outer periphery of the sensor unit 4. Further, the second elastic members 52 are configured as elastic members each having a rectangular parallelepiped shape, and disposed between the sensor unit 4 and the body housing 10 on the right and left sides of the sensor unit 4 such that the centers of gravity of the first surface 521 and the second surface 522 are disposed on the straight line extending in the left-right direction, Each of the second elastic members 52 is held in contact with both the sensor unit 4 (the left wall part 411 or the right wall part 412) and the body housing 10 (the flat-surface part 137 of the side wall 134) via the first surface 521 and the second surface 522. When the sensor unit 4 moves in the left-right direction relative to the body housing 10, the second elastic member 52 can homogeneously expand and contract in the left-right direction, so that the relative movement of the sensor unit 4 in the left-right direction can be more stabilized. Further, the third elastic members 53 are disposed in contact in the up-down direction with the first elastic members 51 mounted onto the sensor unit 4, so that the structure for elastically supporting the sensor unit 4 in the up-don direction is rationally realized by utilizing the first elastic members 51, Further, the magnitude relationship between the spring constant K1 in the front-rear direction and the spring constant K3 in the up-down direction can be appropriately set by combining the first elastic members 51 and the third elastic members 53.

In the present embodiment, the motor 2 is disposed below the drive axis A1 such that the rotation axis of the motor shaft 25 crosses the drive axis A1. Further, the sensor unit 4 is disposed below the motor 2. In this manner, a space within the lower end portion of the motor-housing part 12, which tends to become a dead space, can be effectively utilized. Further, in order to accurately detect the information corresponding to the rotation of the body housing 10 around the drive axis A1, it may be preferable that the sensor unit 4 is disposed as far as possible from the drive axis A1. In the embodiment, the sensor housing space 13 for housing the sensor unit 4 is provided in the lower end portion of the body housing 10 which is farthest away from the drive axis A1 within the body housing 10. Therefore, the sensor unit 4 is arranged optimally in terms of accurate detection of the information corresponding to the rotation of the body housing 10 around the drive axis A1.

The above-described embodiment is a mere example d a work tool according to the present invention is not limited to the structure of the hammer drill 1 of the above-described embodiment. For example, the following modifications may be made. Further, one or more of these modifications may be employed in combination with the hammer drill 1 of the above-described embodiment or the claimed invention.

In the above-described embodiment, the hammer drill 1 which is capable of performing the hammering operation and the drilling operation is described as an example of the work tool, but the work tool may be an electric hammer which is capable of performing only the hammering operation (in which the driving mechanism 3 does not have the rotation-transmitting mechanism 37). Further, the hammer drill 1 may have only the hammer mode and the hammer drill mode as the operation mode.

The operating state of the work tool is not limited to the vibration of the body housing 10 in the front-rear direction and the rotation of the body housing 10 around the drive axis A1, but may be other operating states to be used by the controller 6 for control. For example, it may be a driving state of the motor 2 or a rotating state of the tool holder 39. According to the operating state of the work tool to be used, corresponding information may also be changed. The information corresponding to the vibration of the body housing 10 in the front-rear direction and the rotation of the body housing 10 around the drive axis A1 does not necessarily have to be acceleration, and other physical quantities (such as displacement, velocity and angular velocity, for example) may also be employed. The information corresponding to the vibration of the body housing 10 in the front-rear direction and the information corresponding to the rotation of the body housing 10 around the drive axis A1 may be different kinds of information (physical quantity). The kind and arrangement position of a sensor to be employed in the sensor unit 4 may also be changed according to the information to be detected. For example, the sensor unit 4 may be configured to include a gyro sensor. Further, when plural kinds of information are detected as information indicating an operating state of the work tool, the sensor unit 4 may include a plurality of sensors (detectors) which are configured to detect respective kinds of information, or one sensor which is capable of detecting all of the information.

Further, the spring constant of the elastic support part 5 in each direction and the physical structure of the elastic support part 5 (for example, the number of elastic members forming the elastic support part 5 and a material, shape and arrangement of each elastic member) may be appropriately changed according to the information to be detected. Examples of modifications which may be employed relating to the elastic support part 5 are as follows.

For example, in a case where the hammer drill 1 is configured such that only control of the rotation speed of the motor 2 is performed based on the vibration of the body housing 10 in the front-rear direction and any control for stopping the drilling operation upon excessive rotation around the drive axis A1 is not performed, the elastic support part 5 may be configured such that the spring constant K2 in the left-right direction and the spring constant K3 in the up-down direction are equal to each other and both smaller than the spring constant K1 in the front-rear direction. Similarly, in a case where the hammer drill 1 is configured such that control of the rotation speed of the motor 2 is not performed based on the vibration of the body housing 10 in the front-rear direction and only the control for stopping the drilling operation upon excessive rotation around the drive axis A1 is performed, the spring constants K1, K2, K3 may be appropriately changed. In this case, it may be preferable that the spring constant K1 in the front-rear direction is set considering that larger vibration is caused in the front-rear direction than in other directions in the hammer drill 1 by the hammering operation.

In the above-described embodiment, the elastic members are disposed between the sensor unit 4 and the body housing 10 on opposite sides (for example, the front side and the rear side) of the sensor unit 4 in all of the front-rear, left-right and up-down directions. However, the elastic member may be disposed only on one side of the sensor unit 4 to elastically support the sensor unit 4. Further, in the above-described embodiment, the sensor unit 4 is elastically supported by the elastic support part 5 in all of the front-rear, left-right and up-down directions, but it may be elastically supported only in two of the directions. In this case, considering that vibration in the front-rear direction is the largest vibration in the hammer drill 1 or other work tools which are capable of performing the hammering operation, it may be preferable that the sensor unit 4 is elastically supported in the front-rear direction and in one of the left-right and up-down directions.

In the above-described embodiment, the sensor unit 4 is supported in the front-rear, left-right and up-down directions respectively by the first, second and third elastic members 51, 52 53 having respectively different elastic coefficients and shapes. In the up-down direction, in particular, the sensor unit 4 is elastically supported by combination of the first elastic members 51 and the third elastic members 53. With such a structure, the elastic support part 5 has respectively different spring constants in the front-rear, left-right and up-down directions. However, for example, the elastic support part 5 may include only one elastic member having respectively different spring constants in at least two directions. For example, an elastic member may be fixed to the case 41 in such a manner as to cover the rear wall 415 and the peripheral wall 410 of the sensor unit 4, and the elastic member may also be fixed to the body housing 10. By appropriately setting the respective thicknesses of the elastic member in the front-rear, left-right and up-down directions, the spring constants may be made respectively different in the three or two directions.

Further, the structures of the body housing 10, the handle 17, the driving mechanism 3, and the motor 2 may also be appropriately changed. Examples of modifications which may be employed relating to these structures are as follows.

In place of the body housing 10 of the above-described embodiment, a so-called vibration-isolating housing may be employed. The vibration-isolating housing may include an inner housing which houses at least the motor 2 and the driving mechanism 3 and an outer housing which houses at least a portion of the inner housing and is connected to the inner housing via an elastic member, so as to be movable in at least the front-rear direction relative to the inner housing. In this case, it may be preferable that the outer housing includes the grip part to be held by a user. In a case where the sensor unit 4 is configured to detect information corresponding to vibration in the front-rear direction, it may be preferable that the sensor unit 4 is supported by at least one elastic member so as to be movable in at least two of the front-rear, left-right and up-down directions relative to the inner housing. Further, the shape of the body housing 10 and arrangement of the motor 2 and the driving mechanism 3 within the body housing 10 may be appropriately changed.

In the above-described embodiment, the motion-converting mechanism 30 using the swinging member 33 is employed in the driving mechanism 3, but a well-known crank type motion-converting mechanism may be employed instead. Further, for example, the striking mechanism 36 may be changed to a mechanism which is configured to strike the tool accessory 91 only by the striker 361. The driving mechanism 3 may include a clutch (such as an electromagnetic clutch) which is configured to electrically switch the rotation-transmitting mechanism 37 between a transmission state and a transmission interrupted state. In this case, when the body housing 10 excessively rotates around the drive axis A1 during drilling operation, the controller 6 may stop the drilling operation by switching the clutch to the transmission interrupted state.

Further, in view of the natures of the present invention and the above-described embodiment, the following features can be provided. Each of the features can be employed in combination with any of the hammer drill 1 of the above-described embodiment, the above-described modifications and the claimed invention.

(Aspect 1)

The work tool may further include a controller configured to control operation of the work tool based on the information detected by the detecting mechanism, the two directions may include at least the front-rear direction, the detecting mechanism may be configured to detect, as the information corresponding to the operating state of the work tool, information corresponding to vibration of the housing in the front-rear direction, the controller may be configured to control rotation speed of the motor according to the vibration during the hammering operation, and the elastic support part may be configured such that a first spring constant in the front-rear direction is larger than a second spring constant in a direction other than the front-rear direction of the two directions.

According to the present aspect, the detecting mechanism can appropriately detect the information corresponding to the vibration in the front-rear direction while vibration transmission to the detecting mechanism in a direction other than the front-mar direction is suppressed.

(Aspect 2)

The information corresponding to the operating state of the work tool may be at least one of displacement, velocity, acceleration and angular velocity of the body housing.

(Aspect 3)

The elastic support part may include:

at least one first elastic member each having a first spring constant and disposed between the detecting mechanism and the housing in one of the two directions, and at least one second elastic member each having a second spring constant different from the first spring constant and disposed between the detecting mechanism and the housing in the other of the two directions.

According to the present aspect, the elastic support part can be easily set to have an appropriate spring constant in each of the two directions.

(Aspect 4)

The handle may be connected to the housing via an elastic member so as to be movable in at least the front-rear direction relative to the housing.

According to the present aspect, transmission of vibration from the housing to the handle held by a user can be suppressed.

DESCRIPTION OF THE NUMERALS

1: hammer drill, 10: body housing, 11: driving-mechanism-housing part, 12: motor-housing part, 13: sensor housing space, 131: rear wall, 132: upper wall, 133: lower wall, 134: side wall, 135: rib, 137: planer part, 14: controller-housing part, 15: battery-mounting part, 17: handle, 171: grip part, 173: upper connection part, 174: biasing spring, 175: lower connection part, 176: support shaft, 177: trigger, 178: switch, motor, 25: motor shaft, 26: small bevel gear, 3: driving mechanism, 30: motion-converting mechanism, 31: intermediate shaft, 311: large bevel gear, 32: rotary body, 33: swinging member, 34: sleeve, 35: piston cylinder, 36: striking mechanism, 361: striker, 363: impact bolt, 37: rotation-transmitting mechanism, 39: tool holder, 4: sensor unit, 40: sensor body, 41: case, 410: peripheral wall, 411: left wall part, 412: right wall part, 413: upper wall part, 414: lower wall part, 415: rear wall, 417: recess, 5: elastic support part, 51: first elastic member, 52: second elastic member, 53: third elastic member, 6: contrail 91: tool accessory, 93: battery, 521: first surface, 522: second surface, A1: drive axis

What is claimed is:

1. A work tool configured to perform an operation on a workpiece by driving a tool accessory, the work tool comprising:

a motor;

a driving mechanism configured to perform at least a hammering operation of linearly driving the tool accessory along a drive axis by power of the motor, the drive axis extending in a front-rear direction of the work tool;

a housing that houses at least the motor and the driving mechanism;

a handle connected to the housing, the handle including a grip part, the grip part crossing the drive axis and extending in an up-down direction orthogonal to the front-rear direction;

a detecting mechanism configured to detect information corresponding to an operating state of the work tool; and an elastic support part supporting the detecting mechanism so as to be movable relative to the housing in the front-rear direction and a left-right direction, which is orthogonal to the front-rear direction and the up-down direction, the elastic support part including at least one elastic member disposed between the detecting mechanism and the housing.

2. The work tool as defined in claim 1, further comprising:

a controller configured to control operation of the work tool based on the information detected by the detecting mechanism, wherein:

the driving mechanism is further configured to perform a rotating operation of rotationally driving the tool accessory around the drive axis by power of the motor, the detecting mechanism is configured to detect information corresponding to vibration of the housing in the front-rear direction and information corresponding to rotation of the housing around the drive axis, as the information corresponding to the operating state of the work tool, the controller is configured to control rotation speed of the motor according to the vibration during the hammering operation, and to stop the rotating operation in a case where excessive rotation around the drive axis occurs during the rotating operation, and the elastic support part is configured such that a first spring constant in the front-rear direction is larger than a second spring constant in the left-right direction.

3. The work tool as defined in claim 2, wherein:

the elastic support part supports the detecting mechanism so as to be movable in all of the three directions relative to the housing, and the elastic support part has a third spring constant in the up-down direction which is smaller than the first spring constant in the front-rear direction and larger than the second spring constant in the left-right direction.

4. The work tool as defined in claim 2, wherein:

the at least one elastic member includes:

an annular first elastic member mounted onto an outer periphery of the detecting mechanism and supporting the detecting mechanism so as to be movable in the front-rear direction relative to the housing; and two second elastic members disposed on right and left sides of the detecting mechanism on an imaginary straight line extending in the left-right direction, each of the two second elastic member has a first surface in contact with the detecting mechanism and a second surface in contact with the housing, the first surface and the second surface are in parallel to each other and each have a center of gravity located on the straight line, and each of the two second elastic members has a uniform cross-section along the straight line.

5. The work tool as defined in claim 4, wherein:

the at least one elastic member includes a third elastic member disposed in contact with the first elastic member in the up-down direction, and the first and third elastic members support the detecting mechanism so as to be movable in the up-down direction relative to the housing.

6. The work tool as defined in claim 1, wherein the at least one elastic member includes an annular first elastic member, the first elastic member being mounted onto an outer periphery of the detecting mechanism and supporting the detecting mechanism so as to be movable in the front-rear direction relative to the housing.

7. The work tool as defined in claim 6, wherein:

the at least one elastic member includes a third elastic member disposed in contact with the first elastic member in the up-down direction, and the first and third elastic members support the detecting mechanism so as to be movable in the up-down direction relative to the housing.

8. The work tool as defined in claim 1, wherein:

the at least one elastic member includes at least one second elastic member each having a first surface in contact with the detecting mechanism and a second surface in contact with the housing, the first surface and the second surface are in parallel to each other and opposed in a specified one of the three directions, and a center of gravity of the first surface and a center of gravity of the second surface are located on an imaginary straight line extending in the specified one direction.

9. The work tool as defined in claim 8, wherein:

the at least one second elastic member includes two second elastic members disposed on right and left sides of the detecting mechanism on the straight line extending in the left-right direction, and each of the two second elastic members has a uniform cross-section along the straight line.

10. The work tool as defined in claim 1, wherein:

the motor is disposed below the drive axis such that a rotation axis of a motor shaft extends in a direction crossing the drive axis, and the detecting mechanism is housed in a region of the housing below the motor.

11. The work tool as defined in claim 1, wherein the elastic support part has different spring constants in the front-rear direction and the left-right direction.

12. A work tool configured to perform an operation on a workpiece by driving a tool accessory, the work tool comprising:

a motor;

a driving mechanism configured to perform at least a hammering operation of linearly driving the tool accessory along a drive axis by power of the motor, the drive axis extending in a front-rear direction of the work tool;

a housing that houses at least the motor and the driving mechanism;

a handle connected to the housing, the handle including a grip part, the grip part crossing the drive axis and extending in an up-down direction orthogonal to the front-rear direction;

a detecting mechanism configured to detect information corresponding to an operating state of the work tool; and an elastic support part supporting the detecting mechanism so as to be movable relative to the housing in at least two of the front-rear direction, the up-down direction and a left-right direction, which is orthogonal to the front-rear direction and the up-down direction, the elastic support part including at least one elastic member disposed between the detecting mechanism and the housing, wherein the elastic support part supports the detecting mechanism so as to be movable in all of the three directions relative to the housing.

13. The work tool as defined in claim 12, wherein the elastic support part has different spring constants in the at least two directions.

14. The work tool as defined in claim 13, wherein:

the elastic support part has different spring constants in all of the three directions.

15. The work tool as defined in claim 14, wherein:

the elastic support part has a third spring constant in the up-down direction which is smaller than a first spring constant in the front-rear direction and larger than a second spring constant in the left-right direction.

16. The work tool as defined in claim 12, wherein:

the motor is disposed below the drive axis such that a rotation axis of a motor shaft extends in a direction crossing the drive axis, and the detecting mechanism is housed in a region of the housing below the motor.

17. The work tool as defined in claim 12, wherein the at least one elastic member includes an annular first elastic member, the first elastic member being mounted onto an outer periphery of the detecting mechanism and supporting the detecting mechanism so as to be movable in the front-rear direction relative to the housing.

18. The work tool as defined in claim 17, wherein:

the at least one elastic member includes two second elastic members disposed on right and left sides of the detecting mechanism on a straight line extending in the left-right direction, each of the two second elastic member has a first surface in contact with the detecting mechanism and a second surface in contact with the housing, the first surface and the second surface are in parallel to each other and each have a center of gravity located on the straight line, and each of the two second elastic members has a uniform cross-section along the straight line.

19. The work tool as defined in claim 18, wherein:

the at least one elastic member includes a third elastic member disposed in contact with the first elastic member in the up-down direction, and the first and third elastic members support the detecting mechanism so as to be movable in the up-down direction relative to the housing.

* * * * *